US009758989B1

(12) United States Patent
Simpson

(10) Patent No.: US 9,758,989 B1
(45) Date of Patent: Sep. 12, 2017

(54) LOCKING CAP WITH PUSH BUTTON RESET

(71) Applicant: Gatekeeper Innovation, Inc., Sacramento, CA (US)

(72) Inventor: Joseph C. Simpson, Lincoln, CA (US)

(73) Assignee: GATEKEEPER INNOVATION, INC., Sacramento, CA (US)

( * ) Notice: Subject to any disclaimer, the term of this patent is extended or adjusted under 35 U.S.C. 154(b) by 0 days.

(21) Appl. No.: 14/670,181

(22) Filed: Mar. 26, 2015

Related U.S. Application Data

(60) Provisional application No. 61/967,735, filed on Mar. 26, 2014.

(51) Int. Cl.

| | |
|---|---|
| ***E05B 37/00*** | (2006.01) |
| ***B65D 55/14*** | (2006.01) |
| ***B65D 50/00*** | (2006.01) |
| ***E05B 37/02*** | (2006.01) |

(52) U.S. Cl.
CPC ..... *E05B 37/0058* (2013.01); *B65D 50/00* (2013.01); *B65D 55/145* (2013.01); *E05B 37/0048* (2013.01); *E05B 37/02* (2013.01); *B65D 2215/04* (2013.01)

(58) Field of Classification Search
CPC ..... B65D 50/00; B65D 50/02; B65D 50/06; B65D 55/00; B65D 55/02; B65D 55/14; B65D 55/145; E05B 37/00; E05B 37/0048; E05B 37/0058; E05B 37/02
See application file for complete search history.

(56) References Cited

U.S. PATENT DOCUMENTS

| | | | |
|---|---|---|---|
| 1,358,352 | A | 11/1920 | Wheelock |
| 2,009,216 | A | 7/1935 | Anibal |
| 3,151,756 | A | 10/1964 | Gruen |
| 3,426,932 | A | 2/1969 | Rouse |
| 3,445,021 | A | 5/1969 | Johnson |
| 3,684,117 | A | 8/1972 | Leopoldi et al. |
| 3,843,007 | A | 10/1974 | Meyer |
| 3,901,407 | A | 8/1975 | Mitchell et al. |
| 3,998,078 | A | 12/1976 | Detwiler |
| 4,366,687 | A | 1/1983 | Atkinson |
| 4,383,425 | A | 5/1983 | Orabona |
| 4,520,641 | A | 6/1985 | Bako |
| 4,794,768 | A | 1/1989 | Moser et al. |
| 4,829,796 | A | 5/1989 | Kim |
| 4,907,430 | A | 3/1990 | Hong |
| 4,984,698 | A | 1/1991 | Stuckey |
| 5,277,325 | A | 1/1994 | Yan |
| 5,911,764 | A | 6/1999 | Wei Kong |

(Continued)

FOREIGN PATENT DOCUMENTS

| | | | |
|---|---|---|---|
| CN | 2897860 | Y | 5/2007 |

OTHER PUBLICATIONS

First Office Action for CN 201080049649.2 (English and Chinese; dated Dec. 25, 2013 (15 pgs.).

(Continued)

*Primary Examiner* — Christopher Boswell
(74) *Attorney, Agent, or Firm* — DLA Piper LLP (US)

(57) ABSTRACT

A locking cap having a push button reset and method for operating the locking cap having a push button reset are disclosed. The locking cap with a push button reset system is a deterrent to keep medications in the correct hands.

12 Claims, 8 Drawing Sheets

(56) References Cited

U.S. PATENT DOCUMENTS

| | | | | |
|---|---|---|---|---|
| 6,688,146 | B2 | 2/2004 | Michels et al. | |
| 6,786,346 | B1 | 9/2004 | Gurnard et al. | |
| 6,793,081 | B1 | 9/2004 | Derman | |
| 6,912,878 | B2 | 7/2005 | Beldeti, Jr. | |
| 6,988,642 | B2 | 1/2006 | Gallo, Jr. et al. | |
| 7,350,655 | B2 | 4/2008 | Belden, Jr. | |
| 7,891,220 | B2 * | 2/2011 | Yen | A45C 13/18 70/158 |
| 8,020,415 | B2 * | 9/2011 | Corbin | B65D 55/145 70/168 |
| 8,931,652 | B2 * | 1/2015 | Simpson | B65D 55/145 215/201 |
| 8,938,999 | B2 * | 1/2015 | Dahl | B65D 55/145 70/158 |
| 8,944,263 | B1 * | 2/2015 | Small | E05B 65/0014 215/206 |
| 2003/0089145 | A1 | 5/2003 | Michels et al. | |
| 2004/0011098 | A1 | 1/2004 | Yang | |
| 2006/0207958 | A1 | 9/2006 | Hamer | |
| 2008/0098939 | A1 | 5/2008 | Kalous et al. | |
| 2008/0302794 | A1 | 12/2008 | Wagner et al. | |
| 2011/0049079 | A1 * | 3/2011 | Simpson | B65D 55/145 215/201 |
| 2011/0049080 | A1 * | 3/2011 | Simpson | B65D 55/145 215/201 |
| 2011/0079058 | A1 * | 4/2011 | Nielsen | A61J 1/1437 70/158 |
| 2011/0210136 | A1 * | 9/2011 | Wang | B65D 55/145 220/831 |

OTHER PUBLICATIONS

PCT/US2010/047589 International Preliminary Report Search Report dated Mar. 6, 2012 (7 pages).

PCT International Search Report of PCT/US10/47589; dated Oct. 22, 2010 (2 pgs.).

PCT Written Opinion of PCT/US10/47589; dated Oct. 22, 2010 (6 pgs.).

Extended European Search Report of EP 10814459.3; dated Dec. 12, 2012 (4 pages).

* cited by examiner

LOCKING CAP WITH PUSH BUTTON RESET

PRIORITY CLAIM/RELATED APPLICATIONS

This application claims the benefit under 35 USC 119(e) and 120 to U.S. Provisional Patent Application No. 61/967,735, filed on Mar. 26, 2014 and entitled "Lockable Cap with a Push Button Reset System", the entirety of which is incorporated herein by reference.

FIELD

The disclosure relates generally to a locking cap that may be used on a bottle such as a medical prescription bottle.

BACKGROUND

A need exists to provide a security device to reduce unauthorized teenage, or other unauthorized user, from taking other people's prescription drugs. The unauthorized user is likely to abuse the prescription drug. There is a problem with unauthorized users taking potentially harmful and addictive prescription medications from unmonitored medicine cabinets. People are unaware about how vulnerable their prescriptions can be when the only security device protecting them is a child proof cap. Thus, it is desirable to add a security measure to a bottle. With a more secure bottle, fewer unauthorized users will have access to potentially dangerous and addictive medications. The device prevents an unauthorized user from taking a few pills that could go unnoticed by the prescription drug holder. For example, the security device can be broken in order to gain access, but this action would be noticeable by the prescription drug holder, and therefore further security actions can be taken.

DETAILED DESCRIPTION OF ONE OR MORE EMBODIMENTS

The disclosure is particularly applicable to a medical bottle locking cap with the push button reset and it is in this context that the disclosure will be described. It will be appreciated, however, that the locking cap has greater utility since it may be used to lock various types of bottles (other than prescription medicine or medicine) and may be implemented in a different manner than disclosed below and those alternative embodiments are within the scope of the disclosure.

Figure 1:
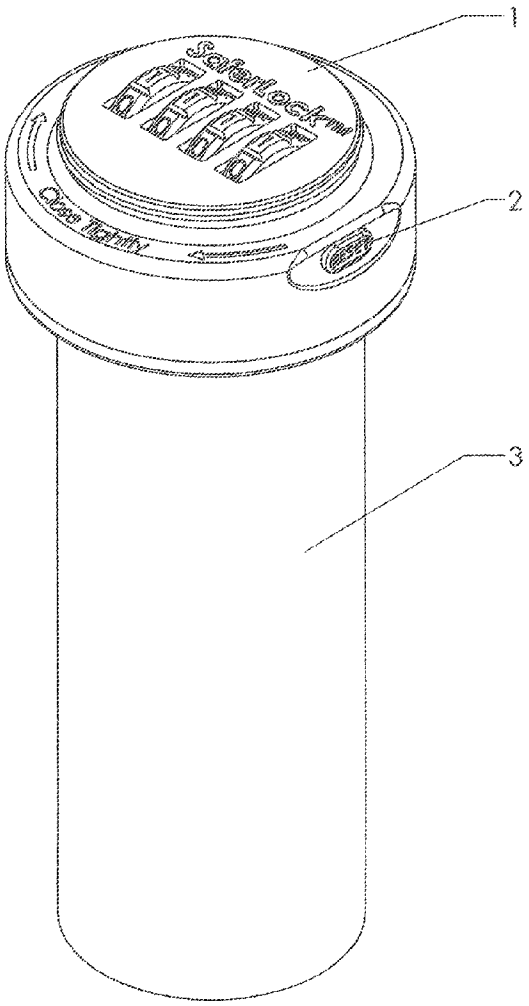
FIG. 1 illustrates an embodiment of a locking cap having a push button reset on a bottle.

FIG. 1 illustrates an embodiment of a locking cap 1 having a push button reset on a bottle 3. The locking cap may utilize a 4 dial combination lock that locks or unlocks the locking cap 1 from the bottle 3. In the example in FIG. 1, the bottle is a tall bottle that has a cylindrical cross-section and may hold a medicine. However, the locking cap 1 may have various shapes and sizes depending in the bottle and/or closure being protected using the locking cap. In addition, the locking cap may have various diameters and heights that are variable dimensions depending in the bottle and/or closure being protected using the locking cap. The locking cap 1 may further comprise a reset button 2 on a portion of the locking cap, such as a side of the cap as shown in FIG. 1. The reset button 2 can be made in different shapes and sizes. The reset button is designed so it can only be used when the locking cap is an unlocked position. When the locking cap is locked, there is a blocking feature (described below) that restricts the movement of the reset system. The reset button, when the locking cap is unlocked, allows the combination of the 4 cogs to be reset by a user. Alternatively to the reset button on the side of the housing as shown in FIG. 1, the reset button may be located on top of the locking cap (adjacent the wheels). One skilled in the art understands that the mechanical connection between the reset button and the cams would be different, but within the scope of the disclosure.

The push button reset 2 is set within the housing. It cannot be removed without noticeable damage. The reset button allows the user to easily reset the combination when unlocked without having to probe the housing with an unattached piece, such as a reset pin. The reset button 2 attached to the housing also makes for a more secure and tamper resistant combination locking closure by eliminating an access hole unauthorized users can potentially tamper with.

Figure 2:
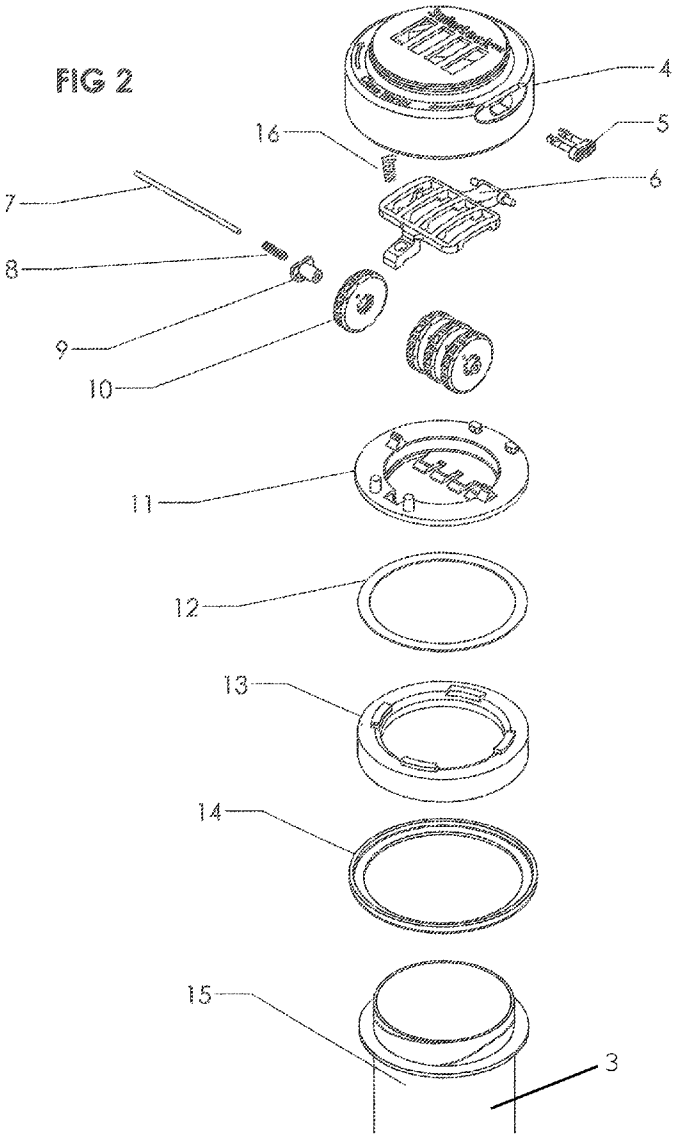
FIG. 2 is an exploded assembly diagram of the locking cap having a push button reset in FIG. 1.

FIG. 2 is an exploded assembly diagram of the locking cap 1 having a push button reset 2 in FIG. 1. In the locking cap 1, each of the pieces shown in FIG. 1 (with the exception of the bottle 3) may fit into a housing 4. All of the pieces of the locking cap may be held within the housing 4 by a lower housing ring 14. To assemble the locking cap with reset push button, a spring 16 may be inserted into a lock plate 6 at point 45. The spring puts a downward pressure on the lock plate. The spring makes the lock plate move down when the cams align into the unlocked position. Once the spring is inserted into the locking plate 6, one or more numbered wheels 10 and a cam 9 for each of the one or more numbered wheels 10 may be aligned on an axle 7 using a small spring 8. In addition to the number dials shown, the locking cap may use wheels/dials that may contain letters or other symbols. In one implementation shown in FIG. 2, the locking cap 1 may have four wheels, but it is understood that the locking cap may have more or less wheels within the scope of the disclosure. The axle 7, spring 8, and number wheel sets 10 and cams 9 may be inserted into the lock plate 6 (that has four opening through which the wheels 10 can protrude) which may be inserted into the housing 4 such that each wheel protrudes through a corresponding opening in the housing 4 as shown in FIG. 1.

A reset button 5 may be then inserted into a portion of the housing, such as a side of the housing as shown in FIG. 2, so that the reset button horizontal axis of motion may be aligned with the side of the cams 9. Next, a tension plate 11 may be inserted into the housing 4 followed by a tension reduction ring 12, and then a lower cap 13. Then a lower housing ring 14 is attached to the housing 4 enclosing the internal components (described above) to create a lockable cap with a push button reset system.

Figure 3:
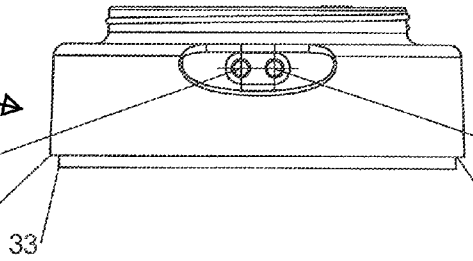
FIG. 3 is a right side view of the locking cap housing.
Figure 4:
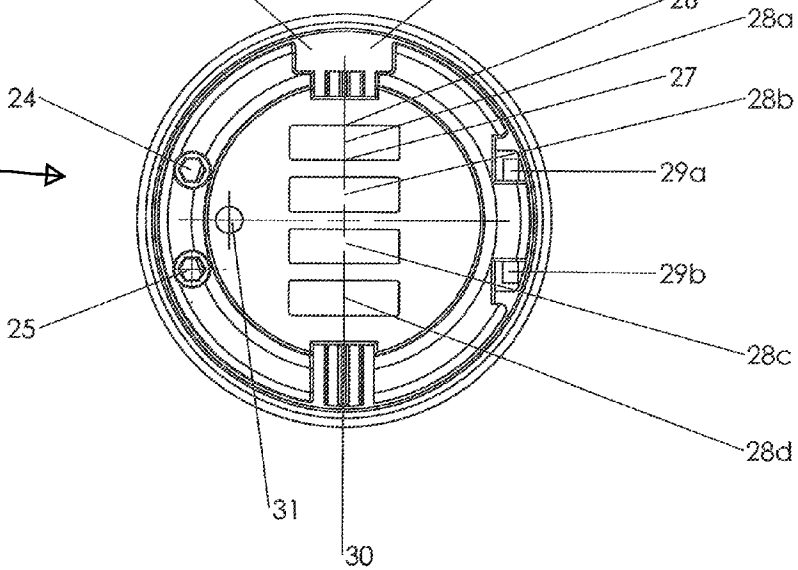
FIG. 4 is a bottom view of the locking cap housing.

FIG. 3 is a right side view of the locking cap housing 4 and FIG. 4 is a bottom view of the locking cap housing 4. The housing 4, when the locking cap has been assembled, contains all of the components within the housing necessary to lock the locking cap. The locking cap is designed to be tamper resistant and to eliminate access to the internal components that a person may try to tamper with to open the locking cap without the proper combination.

The housing 4 is open before assembly at points 20, 21, the lower diameter 33 and points 28*a*, 28*b*, 28*c*, 28*d*. Points 20 and 21 are the holes for the reset button (described below in more detail with reference in FIG. 19) that may be inserted in assembly from the outside of the housing. Once inserted into the housing 4, the locking cap will not allow the reset button 5 to be removed. The lower diameter 33 is a bottom of the locking cap that connects to the bottle such as by a rotating motion so that one or more threads on the housing 4 engage one or more threads on the bottle 1. Points 28*a*, 28*b*, 28*c*, 28*d* are the holes through which the one or more wheels 10 protrude when the locking cap 1 has been assembled.

Components 29*a* and 29*b* hold the pivot point for points 40 and 41 of the lock plate. Components 29*a* and 29*b* are groves in the housing to hold the pivot point of the lock plate in the correct position. At point 30 shown in FIG. 4 designates a midline in which the axle 7 sits when the locking cap is assembled. A point 31 designates a depression in the bottom of the housing 4 that holds spring 2*a*. Spring 2*a* puts pressure on the lock plate 6, forcing the pivot position of 29*a* and 29*b* to allow the lock plate to move downwards dependent on the position of the locking mechanism adjusted at the midline of point 30. The axle 7 sitting at point 30 holds in place the cams 71*d*, 71*c*, 71*b*, 71*a* (as shown in FIG. 7 when a four dial locking cap is implemented) and each cam fits into a corresponding number wheels 78*d*, 78*c*, 78*b*, 78*a* as shown in FIG. 7 when a four dial locking cap is implemented.

The cam and number connection/disconnection determine the following; locked, unlocked, set, and reset. Within the housing the number wheels fit into the position of 28*a*, 28*b*, 28*c*, 28*d* of the housing. The housing restricts side to side movement of the cams. The gaps of 28*a*, 28*b*, 28*c*, 28*d* must be slightly greater that the size of the number wheels 78*d*, 78*c*, 78*b*, 78*a* this allows smooth free spinning of the number wheels. The gap between the housing at 26 and 27 can only be slightly larger than that of the thickness of the number wheel, if the gap is too large it can compromise the security of the locking device. Points 24 and 25 are hexagonal holes which are pressure fits for the tension plate FIG. 11 at points 94 and 95. When a round post is forced into a hexagonal hole the plastic properties act as a connection, making the pressure fit of the housing and the tension plate stick despite the force of spring 2*a* pushing against the pressure fit. The housing contains the inner parts of the combination locking device.

Figure 5:
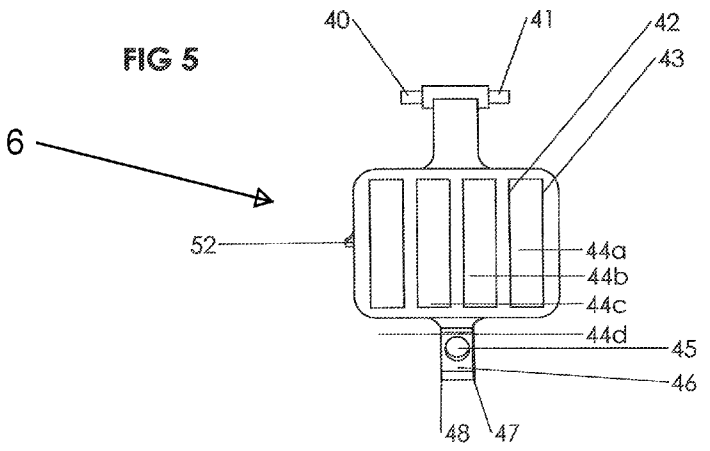
FIGS. 5-7 are a top view, side view and bottom view, respectively, of the locking plate that is part of the locking cap having a push button reset in FIG. 1.
Figure 6:
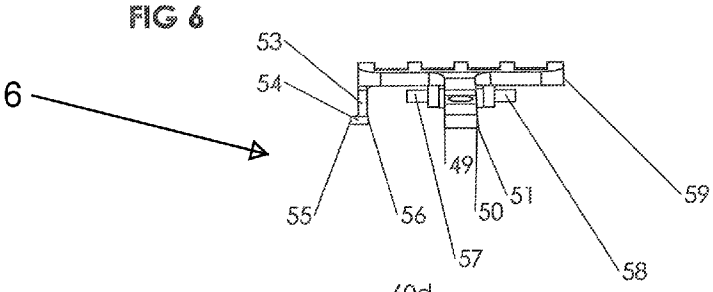
Figure 7:
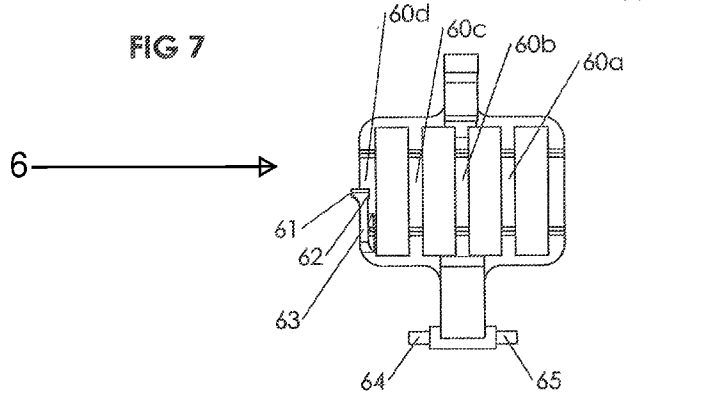

FIGS. 5-7 are a top view, side view and bottom view, respectively, of the locking plate 6 that is part of the locking cap having a push button reset in FIG. 1. The lock plate 6 pivots within the housing between a locking position and an unlocking position. The lock plate 6 may pivot about points 40, 41. The lock plate also allows the reset function to work. The lock plate must prohibit the reset function when it is locked so that someone cannot reset the combination randomly without previously knowing the combination.

Figure 16:
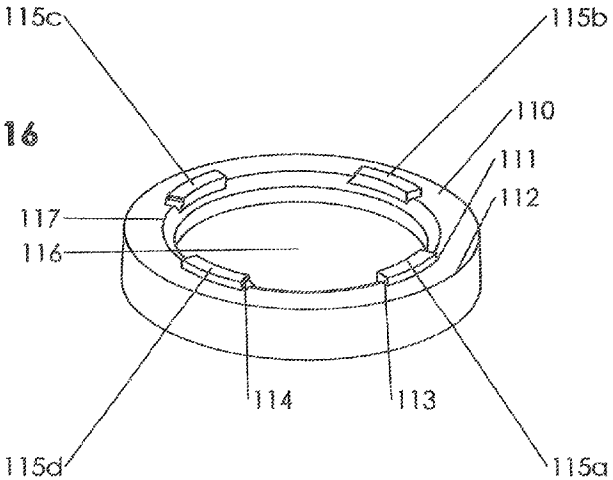
FIG. 16 illustrates a lower cap of the locking cap having a push button reset in FIG. 1.

The lock plate has two up (locked) and down (unlocked). The unlocked position occurs when all the cams align with the flat section up, thus allowing the lock plate to go down and engage the lower cap. When unlocked, the lock plate is down in the space beside the cams, allowing the cams to slide along the axle which allows the numbers/letters/symbols of the wheels to be reset. When the lock plate is up the system is locked. The space on the side of the cam is effectively blocked from moving, making the reset button unable to slide the cam along the axle. When in a locked position, the lock plate 6 rotates upward so that the reset function is forced up and the lock arm is above the lower cap 13, allowing the closure, shown in FIG. 16, to spin freely. Thus, when unlocked, the lower cap 13 in FIG. 16 does not engage with the lock arm 46 of the lock plate, rather it is held above point 115*a*, 115*b*, 115*c*, 115*d* as shown in FIG. 16 that allows the device to slip, or spin without tension. The free spinning of the closure within the housing means that the locking cap is locked. When the lock plate is pivoted down, or in an unlocked position, an end 51 of the lock arm engages the lower cap 13 at point 114 shown in FIG. 16 and this allow tension on the twist cap so that the locking cap can be removed. When putting the cap on, the lock arm 46 of the lock plate at point 48 engages the lower cap 13 at point 113 in FIG. 13 that allows the cap to be twisted onto a bottle.

FIG. 6 is a front view of the locking plate 6. The pivot point can be seen at points 57 and 58 and those pivot points allow the locking plate 6 to rotate between an unlocked position and a locked position. When unlocked, the position will be horizontal as shown in FIG. 6. When unlocked, the lock arm 46 within the positions 49,50,51 will elevate up to the position of the pivot point of 58 and 59. This allows for the lower cap 13 below the lock plate to spin freely. The reset blocking function of FIG. 6 is provided at point 53,54,55,56 of the combination locking closure. This reset blocking feature of the locking plate 6 restricts the reset function when the locking plate 6 is locked. The locking plate in the up position restricts the side movement of the cams. To reset the combination a user pushes the reset button, which slides the cams off the wheels, allowing the wheels to spin independently from the cams, effectively allowing the user to change their combination. When the device is locked, one or more of the cams offsets the locking arm to the up position. In the up position, the lock plate blocks the cams from moving to the side. When the cams are blocked from moving offset from the wheels the combination will not change. The push button will not slide the cams off from the wheels when the device is locked, the lock plate restricts the movement of the push button reset. When the locking plate 6 is locked, the distance between points 55 and 56 on the locking plate 6 (in FIG. 6) sit between points 75 and 77 of FIG. 9 and restrict the movement of the cams relative to the number wheels. To reset the combination on the wheels, the cams may be offset from the number wheels as described below. This design has the cams engaging the numbers wheels from right to left of the front view, cams and number wheels can also engage number wheels from left to right by switching the features which connect them together.

FIG. 7 is a bottom view of the lock plate 6. The blocking arm for the reset function can be seen at the points 61, 62 and 63. This feature blocks the cams from disengaging from the number wheels to prevent the combination from being reset. When locked, the lock plate is in the up position has plastic that holds the cams from being offset by the reset button. The material of the lock plate and the inside of the housing do not have a gap when locked. The cams rest against the material so the reset button cannot slide the cams off the wheels. When the lock plate is unlocked this material on the lock plate is dropped out of the way allowing the cams to slide on the axle when the push button is engaged. When it is released the cams re-engage the wheels with the users new combination. The point from 61, 61 and between 55 and 56 block the cams when the system is locked. When unlocked this feature pivots out of the way and allows the cams to slide on the axle. When the cams slide or are offset the number wheels spin freely allowing the user to reset the combination to a desired preference.

Figure 8:
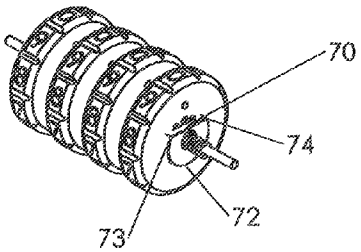
FIG. 8 is a isometric view of the number wheels, cams, axle, and small spring of the locking cap having a push button reset in FIG. 1.
Figure 9:
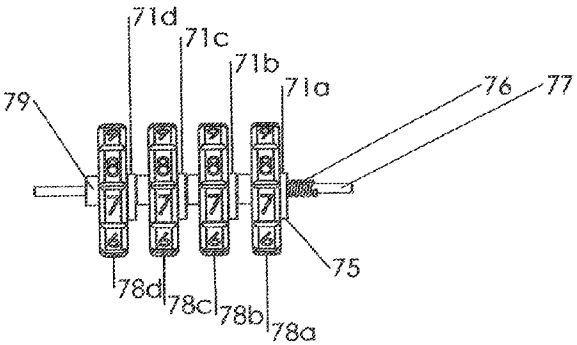
FIG. 9 is a front view of the number wheels, cams, axle, and small spring of the locking cap having a push button reset in FIG. 1.

FIG. 8 is a isometric view of the number wheels, cams, axle, and small spring of the locking cap having a push button reset in FIG. 1 and FIG. 9 is a front View of the number wheels (78*a-d*), cams (71*a-d*), axle (77) and small spring (76). FIG. 10A illustrates a number wheel and cam of the locking cap having a push button reset with a cam in the offset position. When the cam 71 is offset, the number wheel 78*a* can spin freely and this allows the user to select a personal combination. The gears seen at points 81 and 82 on the cams are the features that are disengaged from the number wheels so that the number wheel spins. When connected the number wheels and cams spin as a unit.

Figure 10B:
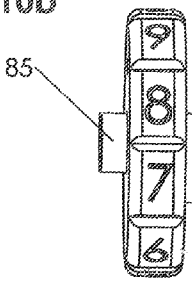
FIG. 10B illustrates a number wheel and cam of the locking cap having a push button reset with a cam in the regular position.
Figure 10C:
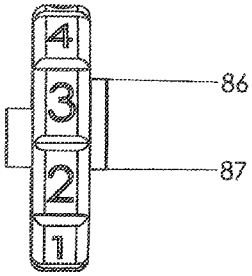
FIG. 10C illustrates a number wheel and cam of the locking cap having a push button reset with a number wheel and cam in a locked position.
Figure 10A:
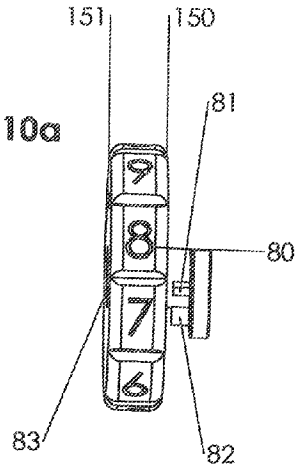
FIG. 10A illustrates a number wheel and cam of the locking cap having a push button reset with a cam in the offset position.

FIG. 10B illustrates a number wheel and cam of the locking cap having a push button reset with a cam in the regular position. This is the position that is held in place by the small spring 76 of FIG. 9 when the device is used. This front position is shown as unlocked, whereas the flat surface of the cam at 84 is up. This flat surface engages the surface of the lock plate at 60*a-d*. When the cams are offset shown in FIG. 10*c* the lock plate is forced upward, effectively locking the system. As shown in FIG. 10C, a flat surface 87 is now on the bottom side. This forces the lock plate upward to the position at 87. One tenth of an offset will change the unlocked position of the cam. The radius between 70, 72, and 73 are the locked positions. When the number wheels and cams are offset they force the lock plate up, effectively locking the device. When the wheels and cams are in their normal position, they spin together. When all the cams have the flat position facing up, the device is unlocked, thus the locking plate is in the down position engaging the lower cap. When one cam is offset from having the flat side facing up, the rounded larger diameter edge of the cam will force the lock plate up, thus disengaging the lower cap and locking the unit. When the lock plate is disengaged from the lower cap, the user cannot put tension on the cap to unlock it, the system will spin on top of the container lacking the tension required to twist the lower cap off the container.

FIGS. 11-14 are an isometric view, a bottom view, a front view and a top view, respectively, of a tension plate 11 of the locking cap having a push button reset in FIG. 1.

Figure 11:
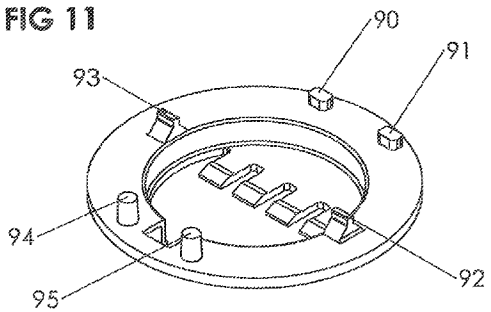

As shown in FIG. 11, the tension plate 11 puts tension on the number wheels, making the numbers "click" when they are rotated due to the finger like structures shown in FIG. 11. The tension plate 11 may also hold the axle in place at points 92 and 93. Features 90 and 91 on the tension plate keep the lock plate 6 in the correct position within the housing. Points 94 and 95 are pressure fits that hold the tension plate 11 into the correct fit of the housing at points 24 and 25 shown in FIG. 4.

Figure 12:
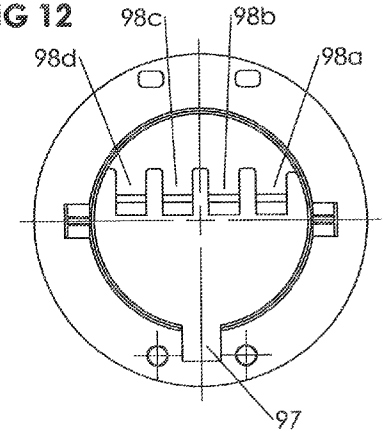
FIGS. 11-14 are an isometric view, a bottom view, a front view and a top view, respectively, of a tension plate of the locking cap having a push button reset in FIG. 1.
Figure 13:
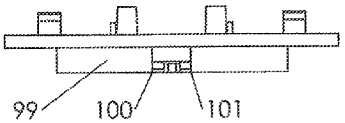
Figure 14:
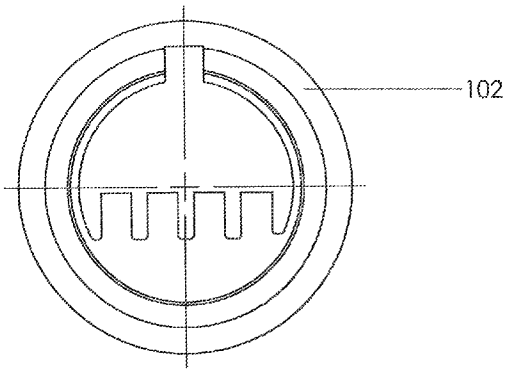

FIG. 12 is a bottom view of the tension plate 11. The tension arms 98*a-d* engage the number wheels and create the clicking. The tension arms of this design sit below the number wheels. The tension arms can also be positioned on the side of the number wheels. Their purpose is to put tension on the number wheels and make the wheels click when the numbers are rotated. As shown in FIG. 13, a gap between positions 100 and 101 are for the lock plate. The lock arm 46 of the lock plate 6 goes through this gap to engage the lower cap 13 below the tension plate 11.

Figure 15:
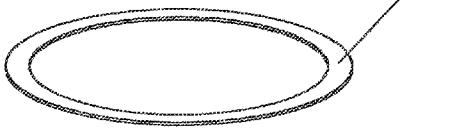
FIG. 15 is a tension reduction ring of the locking cap having a push button reset in FIG. 1.

FIG. 15 is a tension reduction ring 12 of the locking cap having a push button reset in FIG. 1. The tension reduction ring 12 reduces friction between the lower cap 13 and the tension plate 11.

Figure 17:
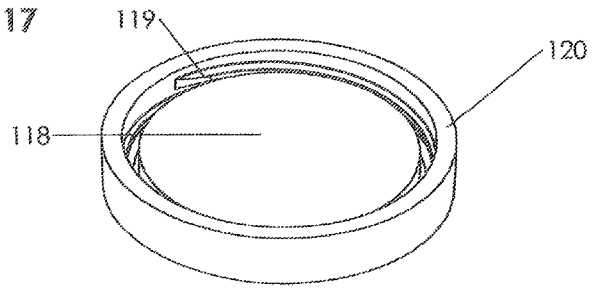
FIG. 17 illustrates a bottom view of the lower cap.

FIG. 16 illustrates a lower cap 13 of the locking cap having a push button reset in FIG. 1. This lower cap 13 fits a twist on bottle. The threads of the twist on bottle can be seen at point 119 of FIG. 17. On a top surface of the lower cap are the 4 extended features 115*a-d* that engage the lock plate when unlocked. When the locking cap is locked and the lock arm 46 is up, and these features do not connect with the lock arm, the lower cap 13 slips and does not allow the bottle to be opened. In the example shown in FIG. 16, four features are shown, but the locking cap may have fewer or more of these features. Furthermore, the shape of the features can be different since any shape may be used to achieve the purpose of allowing the user to put tension on the cap so it can be put on and removed from a bottle that is being secured with by the cap. The lower cap 13 may have a slight offset at point 114 where the angle is slightly more than 90 degrees. This is so the cap cannot be tightened more than the tension applied when removed. The 90 degree angle shown at point 114 help to ensure that when the lock plate engages this face the cap will have enough tension to be removed. In accordance with the disclosure, the lower cap 13 may have many different sizes to fit many different varieties of twist on bottles. This sized cap is large enough whereas the number wheels can be slightly lowered into the cap noted at the dropped surface of the cap at point 118. The surface at point 120 should be smooth so tension is minimal when the unit is locked.

Figure 18:
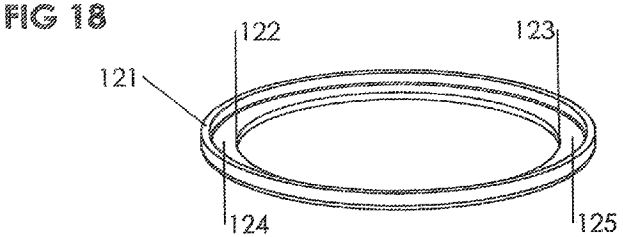
FIG. 18 illustrates a lower housing ring of the locking cap having a push button reset in FIG. 1.

FIG. 18 illustrates a lower housing ring 18 of the locking cap having a push button reset in FIG. 1. This ring holds the pieces within the housing and it can be attached to the housing by glue or by ultrasonic plastic welding.

Figure 19:
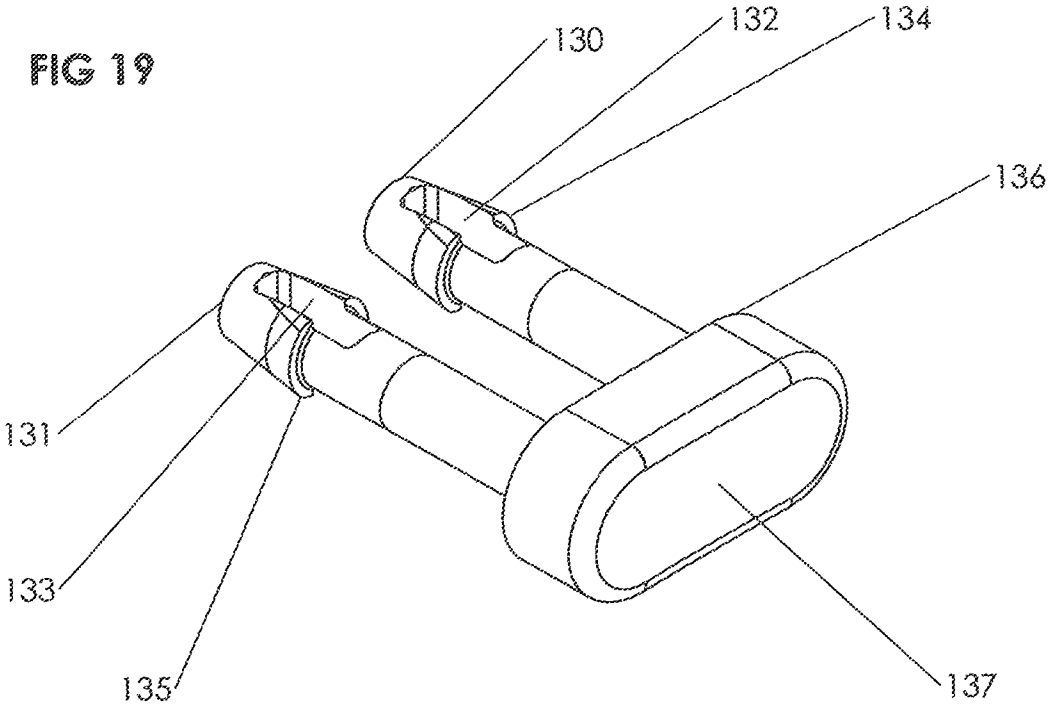
FIG. 19 illustrates more details of the reset button of the locking cap having a push button reset in FIG. 1.

FIG. 19 illustrates more details of the reset button of the locking cap having a push button reset in FIG. 1. The reset button fits into points 20 and 21 of the housing in FIG. 3 and the reset button is designed to engage the cams to allow the combination to be reset under certain circumstances. Specifically, when unlocked and the cams are able to move, a user can apply pressure to the reset button and change the combination. When released, the small spring 76 on the axle 77 will push the reset button back to its resting position concurrently putting the cams back into an engaged position with the number wheels. The reset button is limited in movement by the hard stop piece between 55 and 56 of the lock plate. The system can only be reset when unlocked. When locked, the lock arm 53 of the lock plate 6 will not let the cams be offset from the number wheels so that the reset cannot occur. The reset button in the example above is on the side of the housing, but the reset button can be positioned around the housing, but has to be able to engage the cams. The reset button has to have a restriction when the device is locked and the lock plate 6 restricts the movement of the reset button.

As shown in FIG. 19, the reset button has gaps at points 132 and 133 that will compress as points 130 and 131 are inserted into the housing reset holes at points 20 and 21. When inserted past the points of 134 and 135, the reset button (and the gaps 132, 133) expands back to its original position, and then cannot be removed from the housing. Thus, once the reset button is inserted into the housing at assembly, the points at 20 and 21 are no longer open for an unauthorized user to access and tamper with the mechanism. When locked, the reset button cannot move to depress the spring 76. If this hole is tampered with and bypassed, the device will not unlock itself, the reset function is only properly reset when the combination is in the unlocked position. The reset button is not a key to reset the combination lock whenever desired; only when the device is unlocked can it be reset.

Although certain presently preferred implementations of the invention have been specifically described herein, it will be apparent to those skilled in the art to which the invention pertains that variations and modifications of the various implementations shown and described herein may be made without departing from the spirit and scope of the invention. Accordingly, it is intended that the invention be limited only to the extent required by the applicable rules of law.

While the foregoing has been with reference to a particular embodiment of the disclosure, it will be appreciated by those skilled in the art that changes in this embodiment may be made without departing from the principles and spirit of the disclosure, the scope of which is defined by the appended claims.

The invention claimed is:

1. A device, comprising:

a single piece housing having a cap portion that has an upper surface with a plurality of first gaps therein;

a set of wheels and cams in mechanical relationship with each other, each wheel having a plurality of symbols thereon and the set of wheels being settable to a plurality of combinations, the set of wheels and cams being housed in the housing so that the set of wheels protrude through the first gaps in the cap portion;

an unremovable push button reset located on the cap portion that allows the combination on the set of wheels to be reset; and a lock plate having a pivot point so that the lock plate is pivotably mounted in the single piece housing, the lock plate having an unlocked position and a locked position, wherein the lock plate prevents the cap portion from being removed from a bottle in the locked position and the lock plate prevents the cams from being offset by the push button reset so that the push button reset cannot reset the combination on the set of wheels and wherein the lock plate in the unlocked position allows a user to remove the cap portion from the bottle and pivots out of a path of the push button reset to allow the cams to be offset by the push button reset so that the push button reset is able to reset the combination on the set of wheels.

2. The device of claim 1, wherein the push button reset further comprises a first element and a second element that engage the housing, wherein the first and second elements each have a shoulder element that prevents the push button reset from being removed from the housing once installed in the housing.

3. The device of claim 1, wherein the lock plate limits movement of the push button reset.

4. The device of claim 1, wherein the lock plate is vertically above the set of wheels and cams.

5. The device of claim 1 further comprising a lower cap that engages a bottle and wherein the lock plate in the unlocked position engages with the lower cap to permit the cap to be removed from the bottle and the lock plate in the locked position is disengaged from the lower cap so that the cap cannot be removed from the bottle.

6. The device of claim 1, wherein the push button reset is positioned on a side of the cap portion.

7. The device of claim 1, wherein the push button reset is positioned on a top of the cap portion.

8. The device of claim 1, wherein the lock plate has a plurality of gaps through which the set of wheels protrude.

9. The device of claim 1, wherein the lock plate is located above the the set of wheels and cams.

10. A method, comprising:

providing a locking cap having a single piece housing having a cap portion that has an upper surface with a plurality of first gaps therein, a set of wheels and cams in mechanical relationship with each other, each wheel having a plurality of symbols thereon and the set of wheels being settable to a plurality of combinations, the set of wheels and cams being housed in the housing so that the set of wheels protrude through the first gaps in the cap portion, a push button reset located on the cap portion that allows the combination on the set of wheels to be reset and a lock plate pivotably mounted in the single piece housing having an unlocked position and a locked position;

preventing the push button reset from being removed from the single piece housing once the push button reset is installed into the single piece housing;

preventing, when the lock plate is in the locked position, the cap portion from being removed from a bottle in the locked position and preventing the cams from being offset by the push button reset so that the push button reset cannot reset the combination on the set of wheels; and pivoting the lock plate out of a path of the push button reset and allow the cams to be offset by the push button reset so that the push button reset is able to reset the combination on the set of wheels.

11. The method of claim 10, wherein preventing the push button reset from being removed from the single piece housing further comprises expanding a shoulder element of the push button reset to engage the single piece housing once the push button reset is installed in the single piece housing.

12. The method of claim 11, wherein preventing the push button reset from being removed from the single piece housing further comprises expanding a second shoulder element of the push button reset to engage the single piece housing once the push button reset is installed in the single piece housing.

* * * * *